US005263263A

United States Patent [19]

Gheorghiu et al.

[11] Patent Number: 5,263,263

[45] Date of Patent: Nov. 23, 1993

[54] ROTARY DIELECTRIC DRYING OF CERAMIC HONEYCOMB WARE

[75] Inventors: Tudor C. Gheorghiu, Painted Post; Donald L. Guile, Horseheads; Arthur E. Hillman, Campbell; G. Daniel Lipp; Larry J. Zook, both of Painted Post, all of N.Y.

[73] Assignee: Corning Incorporated, Corning, N.Y.

[21] Appl. No.: 23,933

[22] Filed: Feb. 26, 1993

[51] Int. Cl.[5] ..... F26B 3/34

[52] U.S. Cl. ..... 34/1 L; 34/105; 34/21; 34/1 K; 34/68; 34/17; 264/57

[58] Field of Search ..... 34/104, 105, 21, 236, 34/1 E, 17, 68, 1 L, 1 K, 216–217; 264/57, 58, 25, 26

[56] References Cited

U.S. PATENT DOCUMENTS

| | | | |
|---|---|---|---|
| 2,737,569 | 3/1956 | Brown et al. | 34/1 R |
| 3,372,445 | 3/1968 | Maurer et al. . | |
| 3,953,703 | 4/1976 | Hurwitt . | |
| 4,162,285 | 7/1979 | Tanabashi . | |
| 4,439,929 | 4/1984 | Kitagawa et al. | 34/1 J |
| 4,492,571 | 1/1985 | Miura | 34/105 |
| 4,629,849 | 12/1986 | Mizutani et al. . | |
| 4,692,581 | 9/1987 | Mizutani . | |
| 4,757,617 | 7/1988 | Ishigurd | 34/104 |
| 4,837,943 | 6/1989 | Mizutani | 34/1 E |
| 4,857,245 | 8/1989 | Oshima . | |
| 4,866,857 | 9/1989 | Clasen . | |

FOREIGN PATENT DOCUMENTS 141970 4/1980 Fed. Rep. of Germany .

*Primary Examiner*—Henry A. Bennet
*Assistant Examiner*—Denise Gromada
*Attorney, Agent, or Firm*—Angela N. Nwaneri

[57] ABSTRACT

Novel method and apparatus are disclosed for dielectrically drying green ceramic or wet honeycomb structures, by rotating such structures about their longitudinal axis between a pair of parallel dielectric electrodes and simultaneously blowing heated air through the longitudinal cells of the honeycomb structure. Preferably the dielectric electrodes are oriented parallel with the longitudinal axis of the honeycomb structure, and the rotation thereof between the electrodes accordingly results in a more uniform energy transfer to the honeycomb structure by leveling out the non-uniformities and variations in the dielectric field.

20 Claims, 4 Drawing Sheets

PIECE TEMPERATURE RANGE
vs.
ORIENTATION OF THE ELECTRODES

TEMP. (°C)
160
140
120
100
80
60
40
20
0
0
100
200
300
400
TIME (sec)
a
b
c

ROTARY DIELECTRIC DRYING OF CERAMIC HONEYCOMB WARE

BACKGROUND OF THE INVENTION

This invention relates to the art of producing thin-walled honeycomb structures, such as those that would have utility as a catalyst substrate or as a diesel particulate filter. Such substrates may be formed from extrudable material such as particulate ceramic and/or metal batches which may be sintered, and similar materials which have the property of being able to flow or plastically deform during extrusion, while being able to become sufficiently rigid immediately thereafter so as to maintain their structural integrity, in the manner set forth in U.S. Pat. Nos. 3,790,654 and 4,758,272. Alternatively, the honeycomb structure may be made of pleated thin porous sheets of filter material whose layers are interleaved with corrogated or crimped spacers with parallel corragations or crimps thereof extending substantially perpendicular to the folds of the pleated sheets, as disclosed in U.S. Pat. Nos. 2,884,091, 2,952,333 and 3,242,649.

The invention more particularly relates to improved method and apparatus for drying wet honeycomb structures, formed of such particulate material or sheets, of virtually any desired size and shape of transverse cross-section. Honeycomb ware is typically manufactured by extruding or fabricating ceramic material into logs, followed by the drying, cutting and firing of such ceramic logs. The drying of such honeycomb logs must be done very carefully in order to not induce stresses in the honeycomb ware pieces, produced by non-uniform drying and shrinkage, which can create distortion, warping or cracking. Conventional convection or oven drying cannot be used, particularly with the relatively large logs required for diesel particulate filters, which in their green state may be 16 to 18 inches long, transverse cross-sectional diameters of 6 to 16 inches, and weighing up to about 70 lbs., since by its nature, convection drying dries the ware from the outside inwardly, and the early outside drying results in the shrinking of the outer layers, thereby invariably leading to cracking or distortion, rendering the product unusable.

Some forms of dielectric drying through the use of dielectric heating have been utilized in the past. However, due to non-uniform radio frequency fields between the dielectric electrodes and the orientation of such electrodes relative to the honeycomb ware, the results obtained with such prior art devices and methods were not entirely satisfactory. Typically, the larger green ceramic honeycomb structures were initially subjected to dielectric drying for about 25 minutes followed by hot air convection drying for about 72 hours. Not only was the required total drying time excessive, but also the available radio frequency fields produced by the dielectric heating are not uniform, thus resulting in a variable drying pattern within the honeycomb structure.

Accordingly, it is the object of the present invention to provide improved method and apparatus for efficiently and uniformly drying green ceramic honeycomb structures without distorting, warping or cracking the structure and thus minimizing the development of harmful stresses within the structure.

SUMMARY OF THE INVENTION

In its simplest form, the present invention sets forth method and apparatus for efficiently and uniformly drying wet honeycomb structures without inducing stresses within such structures due to shrinkage caused by non-uniform drying. The method of the present invention which provides the improved drying of green or wet honeycomb structures includes the steps of: (1) orienting dielectric electrodes parallel with the longitudinal axis extending through the honeycomb structure, (2) rotating the honeycomb structure about its longitudinal axis, (3) initially subjecting the honeycomb structure to dielectric drying, and (4) blowing heated air through the cells extending longitudinally through the honeycomb structure.

DETAILED DESCRIPTION OF THE INVENTION

In order to accomplish the desired rapid, uniform and complete drying of green ceramic or wet honeycomb structures, the present invention incorporates the utilization of dielectric heating, a unique orientation of dielectric electrodes relative to the position of the honeycomb structure, the rotation of the honeycomb structure about its longitudinal axis, and the flowing of heated air through the longitudinally extending cells of the honeycomb structure to, in effect, produce a synergistic result. The drying of the green honeycomb structure is accomplished through the use of dielectric heating, which is radio frequency (RF) heating, in which energy is released in a non-conducting medium through dielectric hysteresis. The advantage of dielectric drying over standard convection or oven drying is the fact that in RF drying, the energy passes through the entire honeycomb structure and is absorbed wherever there is water or other RF absorbing materials, and as a result the heating takes place throughout the honeycomb structure and the subsequent drying and shrinking are relatively uniform.

However, as currently practiced, the available RF fields are not uniform, and such fields are further modified by the presence of the wet honeycomb structure, resulting in a variable drying pattern. Although RF drying is preferable to convection drying, a non-uniformity still exists which can result in the dryest parts of a structure becoming overheated and damaged when attempting to dry the wettest parts of the honeycomb. We have discovered, however, that by positioning or orienting the dielectric electrodes parallel to the longitudinal axis of the honeycomb structure extending longitudinally through its cells, and by rotating the honeycomb structure about its longitudinal axis, the non-uniformity problem is overcome. That is, the rotation of the ware within the RF field cancels out most of the effect of the RF field variations, by positioning each portion of the ware in a variety of locations in the RF field, and resulting in a smoothed, average energy transfer.

Preferably, after the temperature of the honeycomb ware has been raised and partially dried with RF energy, and while such ware is still being heated by the RF field, hot air is passed longitudinally through the cells of the honeycomb structure. The hot air serves to remove evaporated moisture which otherwise must diffuse out of the honeycomb channels or cells. As a result, the partial pressure of water vapor in the cells is greatly reduced and the evaporation rate increases. This combination of a smoothed out RF energy, through rotation of the ware, together with parallel electrode orientation to uniformly supply the heat of evaporation throughout the honeycomb ware, and the hot air flow to quickly remove the resulting water vapor, provides an unusually fast and uniform drying process.

Figure 1:
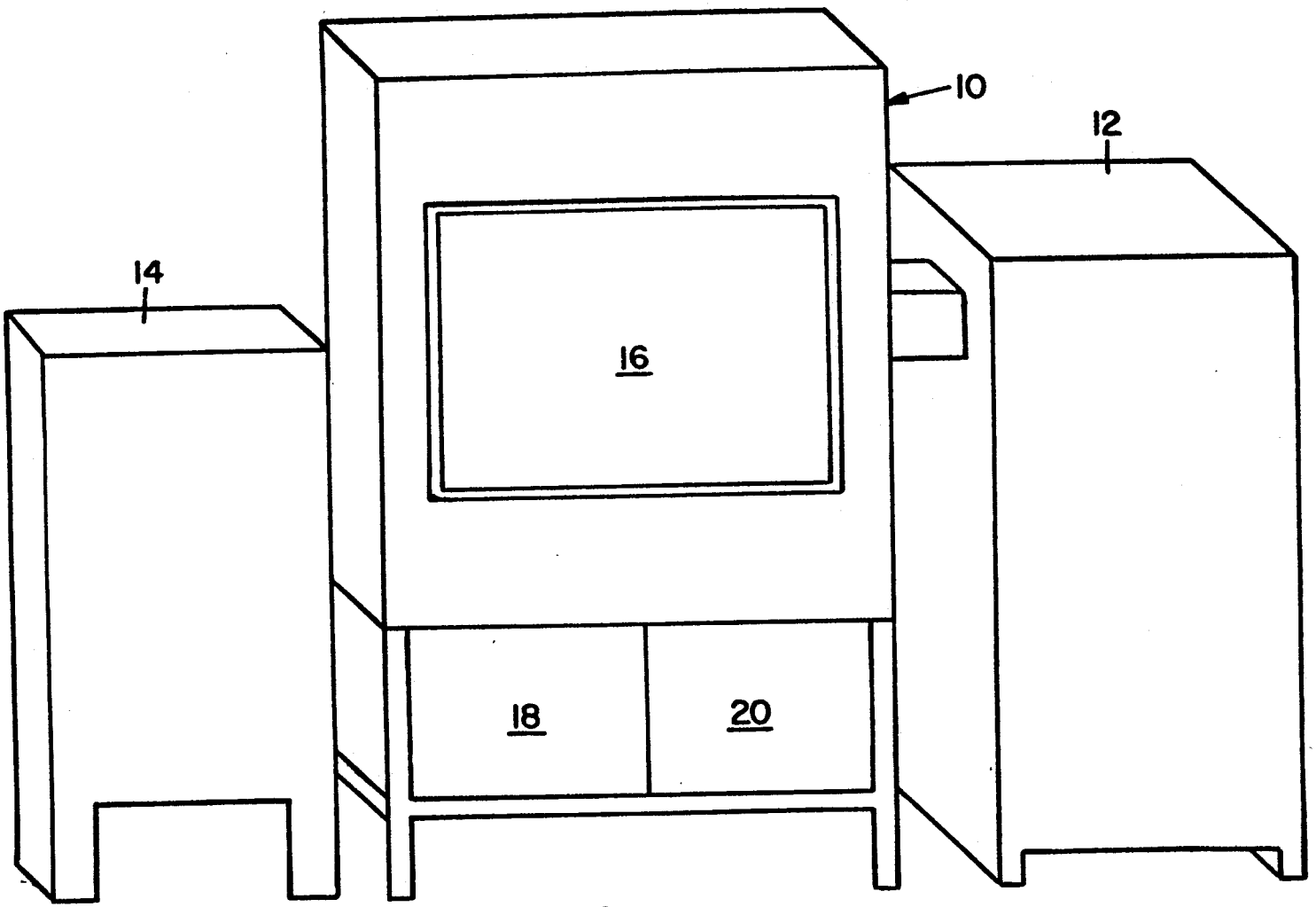
FIG. 1 is a schematic block diagram of representative apparatus for carrying out the present invention.

Referring now to the drawings, and particularly FIG. 1, a schematic illustration of apparatus which may be used to carry out the present invention is shown. The apparatus includes a drying oven 10, an RF power unit and control cabinet 12, and a control cabinet 14 for controlling the velocity and temperature of the air supplied to the honeycomb structure, and the rate of rotation of the turntable upon which the honeycomb structure is positioned. The drying oven 10 is provided with an access door 16 and a suitable heater 18 for heating the air to be supplied to the ware, and a fan 20 for controlling the velocity of the air supplied to the honeycomb structure.

Figure 2:
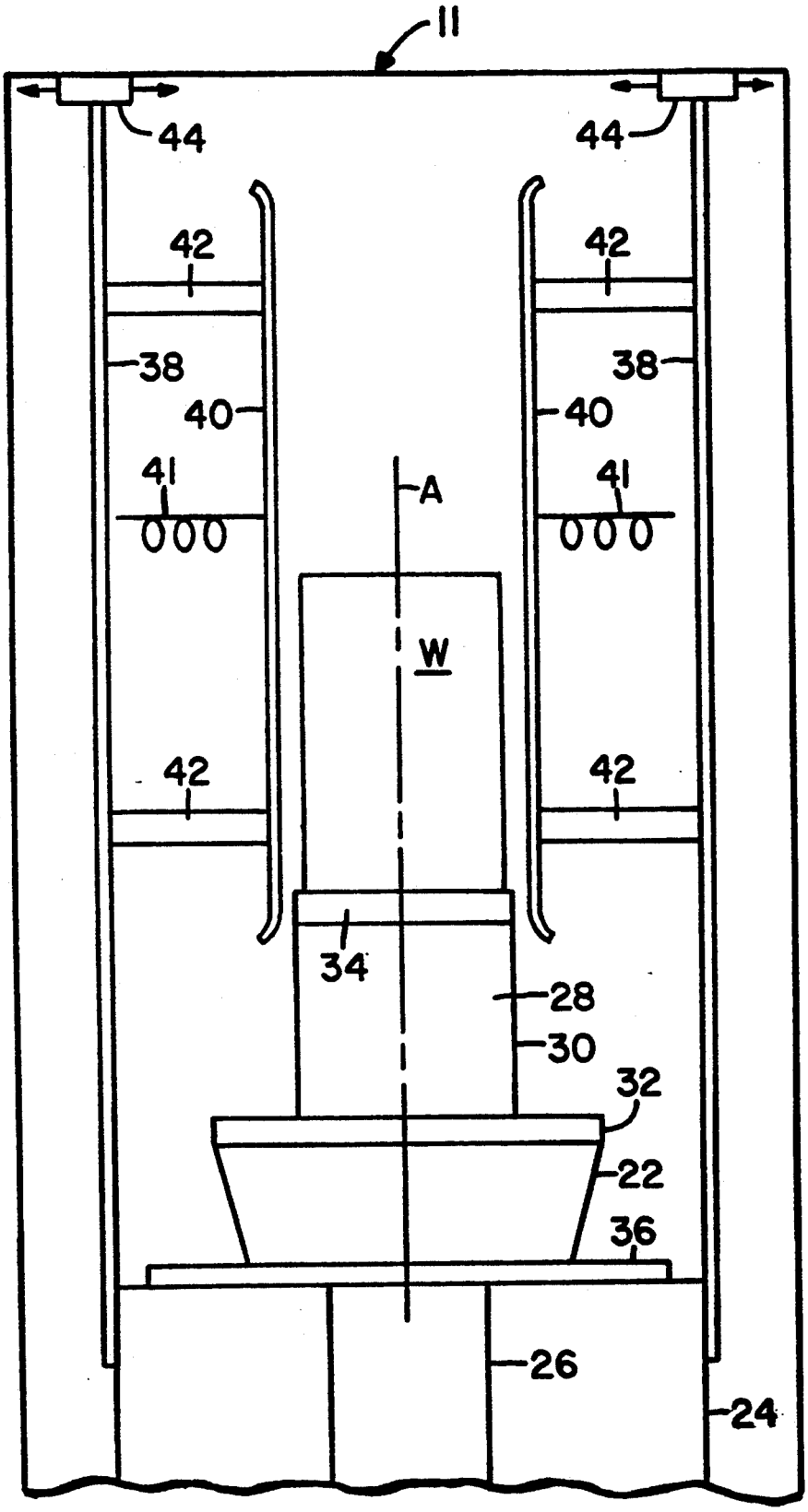
FIG. 2 is a somewhat schematic representation of essential operating portions of the drying apparatus embodying the present invention.

Referring now to FIG. 2, the interior working structure of the drying oven 10 is schematically disclosed. A turntable 22 is rotatably mounted upon a lower support structure 24. An air inlet duct 26 communicates with the turntable 22 and is operably connected with the heater 18 and fan 20 positioned in the lower portion of the drying oven 10, which are controlled through control cabinet 14.

The turntable 22 is mounted for rotation upon an upper surface of the lower support structure 24. Preferably, the turntable is made of a material which is transparent to RF energy, such as most ceramics and plastics. A hollow carrier 28, having a cylindrical upper portion 30 and a lower disk portion 32, is positioned upon the upper open end of turntable 22, such that the disc portion 32 engages the open end of the turntable. Preferably, the carrier 28 is made of a material, such as fiberglass/epoxy, and fired ceramic material (preferably, fired ceramic honeycomb), which is transparent to RF energy, and accordingly is not heated by such energy. A perforated support disc 34 which is transparent to RF energy, operatively fits within the upper open end of the carrier 28 and functions as an open free-flowing support for a green ceramic or wet honeycomb ware structure W positionable thereon.

Heated air from the heater 18 is forced at a desired velocity by fan 20 through the air inlet duct 26 into the hollow turntable 22. The turntable may be provided with a plurality of air diverters in order to effect the distribution of the air flow upwardly through the hollow carrier 28, the open honeycomb support disk 34 and through the longitudinal cells of the ware W. The turntable 22, carrier 28 and disk support 34 are all aligned so that the longitudinal axis A of the honeycomb ware structure W is coincident with the axis of rotation of the turntable 22. Thus, the turntable 22 rotates the honeycomb ware W about its longitudinal axis A, which extends parallel with the longitudinally extending cells of the honeycomb structure. In addition, the flow of heated air, supplied to the honeycomb structure W, also flows parallel with the longitudinal axis A and thus flows through the cells of the ware.

A pair of support plates 38 are positioned within the drying oven 10 and support dielectric electrodes 40 by means of insulated standoffs 42. The electrodes 40 are preferably planar and extend parallel with the longitudinal axis A of the honeycomb ware W, but could be contoured to complement the curvature of the ware in a batch process, if desired. The support plates 38 may be secured to the lower support structure 24 and the shell or inner wall 11 of the drying oven 10, as shown, or they may be adjustably positioned on support rods so as to be able to vary the spacing between the electrodes 40. That is, when the drying oven 10 is to be utilized solely for a given product size, the support plates 38 may be permanently affixed with a given electrode spacing. However, when a plurality of ware sizes are to be utilized in a given oven, it is preferable to have the support plates adjustably mounted on support rods operatively attached to the oven structure.

As previously mentioned, it may be desirable, from an operational standpoint, to be able to vary the distance between the electrodes 40, and thereby vary the RF field between such electrodes. In such a case, the support plates 38 would not be secured to supporting structure of the oven 10, but rather could be attached to motorized screw adjustment means 44, such as shown at the top of the support plates 38. If desired, such motorized screw adjustment means could be secured to suitable support rods secured to the frame of the oven 10. The dielectric electrodes 40 are of course operatively connected to the RF power unit 12 by suitable leads 41.

The basis of the present apparatus may be utilized either for batch operations or for continuous drying processes. For example, again referring to FIG. 2, in a continuous drying operation, the oven 10 would extend longitudinally into the page of the figure, and the upper surface 36 of the lower support structure 24 would be in the form of a conveyor or a series of trollies for moving a plurality of turntables 22 longitudinally there along into the page of FIG. 2, while incorporating suitable gearing for rotating each table and its associated carrier and ware, such that the ware is rotated about its longitudinal axis as it moves parallel with and between the electrodes 40, also extending into the page of the figure. Needless to say, the air duct 26 would extend along underneath the trollies or conveying mechanism 36.

In operation, the electrodes 40 are positioned parallel to one another at a desired spacing relative to the wet honeycomb ware structure to be dried. In addition, the electrodes are evenly spaced from the axis A of rotation of the turntable 22. A green ceramic or wet honeycomb ware structure W to be dried is positioned upon the open or honeycomb support disk 34, such that its longitudinal axis A is virtually coincident with the axis of rotation of the turntable 22. The turntable 22 is then energized by control cabinet 14 to rotate the ware W about its longitudinal axis A on the support disk 34 evenly between the electrodes 40, which are oriented parallel with the longitudinal axis A of the ware W. The rotation of the turntable 22, controlled by control cabinet 14, may vary from about ¼ rpm to about 10 rpm, with a preferred range being between about 1 and 6 rpm.

An RF generator is positioned within and controlled by control cabinet 12 to supply RF energy via leads 41 to the electrodes 40 to produce an RF field therebetween. The amount of voltage applied to the electrodes 40 will of course vary depending upon the size of the RF generator being utilized, the size of the ware item being dried, and the moisture content within such ware. However, with a 10-KW RF generator, voltages of about 10 to 20 KV have been successfully applied.

With the ware item W rotating about its longitudinal axis A between the RF energized electrodes 40, extending parallel to said longitudinal axis, it is preferred to delay the application of forced heated air through inlet duct 26 until evaporation of water from the cell walls is substantially uniform throughout the length of the ware. The length of the delay or the point at which this uniform evaporation is attained for a given ware is determined by experimentation. In general, the appropriate delay will depend on process variables such as the RF energy level, air flow rate, air temperature, the size and shape of the ware, ware composition etc. One indicator of the point at which forced heated air can be applied without stress cracking (i.e., when uniform water evaporation is attained), is ware temperature. For example, for the large ceramic bodies used for experimentation, we observed that uniform water evaporation was attained at ware temperatures of 80° to 90° C. At these ware temperatures, forced air flow did not produce stress cracking in the ceramic ware.

Accordingly, after a predetermined delay wherein only RF energy is applied to the rotating ware W so as to uniformly heat and evaporate water from the ware, heated forced air is applied through inlet air duct 26 by means of heater 18 and fan 20, as controlled by control cabinet 14. The heated air flow from inlet duct 26 passes through the turntable 22, the hollow carrier 28, through the openings of the honeycomb disk support 34, and upwardly longitudinally through the longitudinally extending cells of the honeycomb structure W. The temperature and velocity of the air supplied to the honeycomb ware W to be dried, is controlled by the control cabinet 14 which operates the heater 18 and the fan 20. Although air temperatures between about 80° C. and 150° C. have been successfully utilized, it is preferred to utilize an air flow at a temperature of about 100° C.+or −20°. Further, air velocities between about 2 meters per second and 5 meters per second have been successfully utilized. Also, the velocity of the air supplied to the ware W may be varied during the drying process, if desired, such that a reduced initial velocity may be supplied and then a greater velocity may be provided to hasten the final drying.

Due to the fact that the green ceramic or wet honeycomb ware W is placed with its longitudinal channels or cells parallel to the electrodes 40, and rotated about its longitudinal axis A in the RF field, all parts of the ware are exposed to the same RF field, thus producing a uniform energy transfer by leveling the non-uniformities and variations of the RF field to produce a virtually stress-free drying of the ware.

Figure 3:
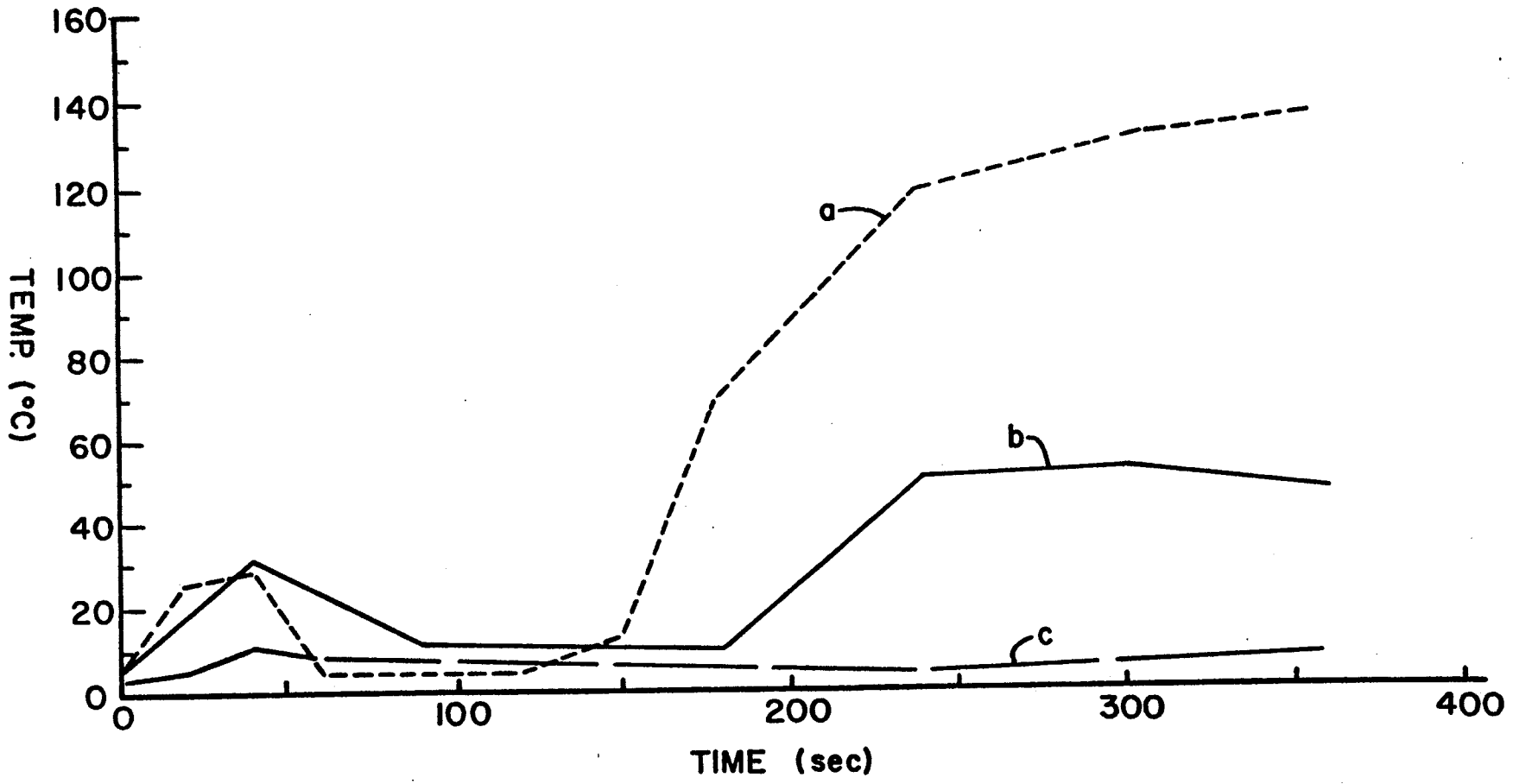
FIG. 3 is a graph illustrating the range of temperature within a honeycomb structure during a drying cycle, relative to the orientation of the dielectric electrodes.

Referring now to FIG. 3, the benefits of orienting the electrodes 40 so as to be parallel with the longitudinal axis A of the ware W and rotating the ware about its longitudinal axis A, are set forth. That is, FIG. 3 shows the variation in temperature within a ware piece during an RF drying cycle, wherein the line a of the graph shows a temperature variation of about 140° C. within a ware piece when the dielectric electrodes are positioned perpendicular to the longitudinal axis of the ware. The line b of the graph shows a temperature variation of only about 50° C. within a ware piece when the dielectric electrodes are positioned parallel to the longitudinal axis of the ware. Finally, the line shows a variation of less than 10° within a ware piece when the dielectric electrodes are positioned parallel to the longitudinal axis of the ware piece, the ware piece is rotated about its longitudinal axis between such parallel electrodes, and air is blown longitudinally through the piece, providing what might be considered a synergistic effect.

A further advantage of orienting the dielectric electrodes parallel with the longitudinal axis of the honeycomb ware is the fact that the ends of the ware, through which the heated air is blown for drying, are not obstructed by the electrodes, and accordingly the removal of water from the honeycomb ware is not inhibited by the placement of the electrodes.

The blowing of heated air parallel with the longitudinal axis and through the channels of the honeycomb ware functions to remove water vapors and reduce the vapor pressure in the channels, which further accelerates the rate of water evaporation from the honeycomb walls. The air can have different velocities, temperature and humidity contents, and by varying the same, the drying process can be shaped as desired.

Figure 4:
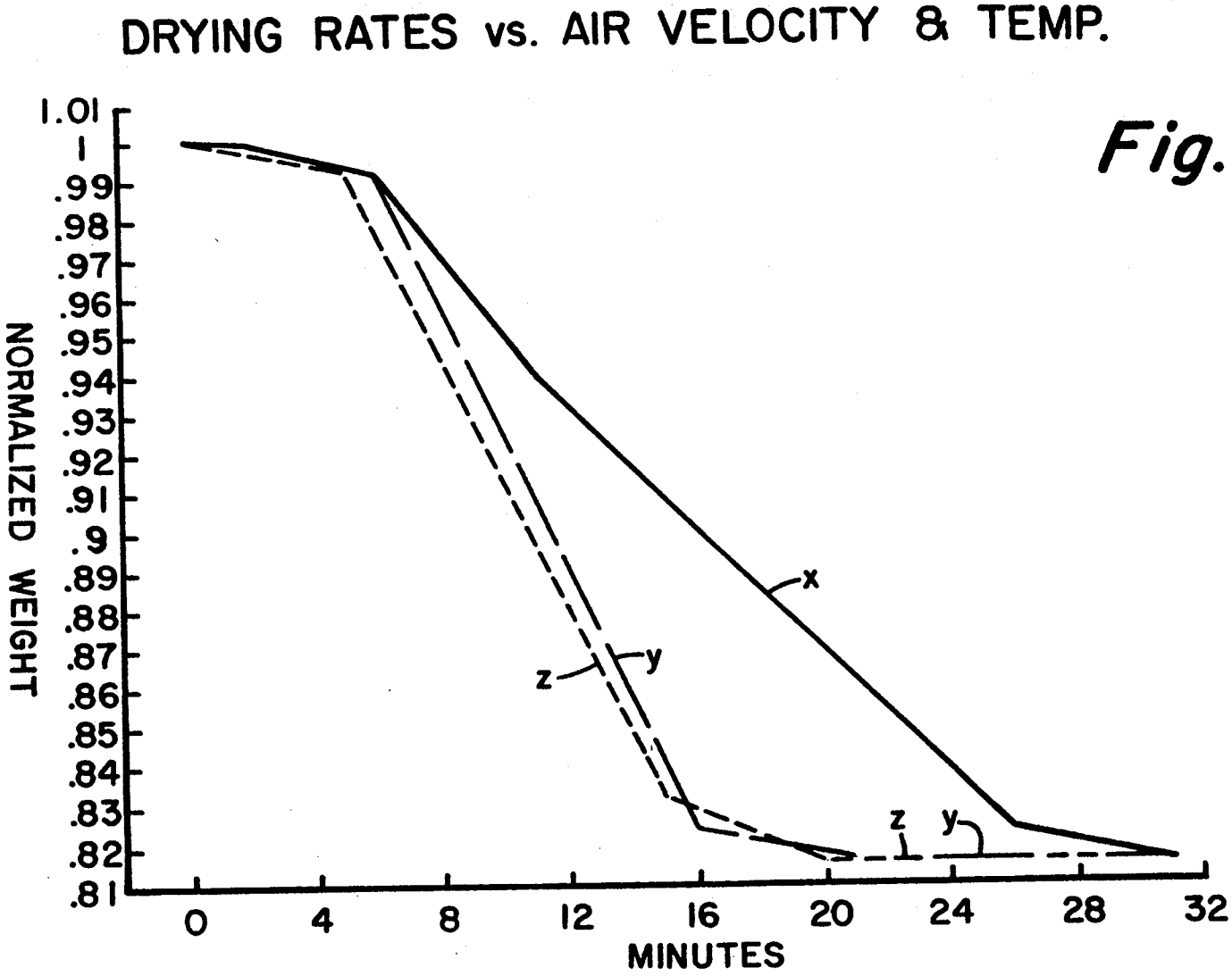
FIG. 4 is a graph illustrating various drying rates which ar obtainable with different air velocity and air temperature settings.

It has been found that drying rates are affected more by the velocity of the air flow provided to the ware as opposed to the temperature of such air flow. Referring now to FIG. 4, a series of three lines are shown on the graph representing the drying rates for different air velocities and air temperatures. In each case, RF energy was applied for a period of six minutes in order to uniformly dry the ware sufficiently so that the application of heated air would not create stresses and resulting cracks.

In the case of the graph represented by line x, air was supplied after six minutes of RF drying at a velocity of about 2 meters per second and at a temperature of 100° C., and it can be seen that it took about 31 minutes to dry the ware. In the case of the graph designated by y, air at a velocity of about 5 meters per second and at a temperature of 150° C. resulted in drying the piece in about 21 minutes. Finally, the graph represented by z had air supplied to the ware after a period of six minutes of RF drying at a velocity of about 5 meters per second, but at a temperature of only 100° C., and it can be seen that the ware dried in about 20 minutes. Accordingly, higher air flows do in fact speed up the drying, whereas the difference between a temperature of 100° C. and 150° C. at the same air velocity, does not produce a significant difference in drying time. Below 100° C., air temperature will significantly affect drying rate.

Further, it has been observed that rotation rates of the turntable 22 between about ¼ rpm and 6 rpm had no significant affect on the drying of the ware.

As a specific example, but by no means limiting in nature, a green ceramic honeycomb extrusion approximately 13.5 inches in diameter and 17 inches in length, and weighing about 60 lbs., was positioned on the honeycomb support disk 34, with the longitudinal axis A thereof being virtually coincident with the axis of turntable 22 and parallel with the dielectric electrodes 40 which were spaced apart with an electrode gap of 15.5 inches. RF energy was applied to the electrodes 40 by means of control cabinet 14 at about 18 KV while the ware was rotated about its longitudinal axis at 6 rpm. After a period of 6 minutes, air at 100° C. was introduced through inlet duct 26 at a velocity of about 2 meters per second for flow longitudinally through the longitudinal cells of the ware W. After a period of 24 minutes from the beginning of the drying operation, the RF energy was turned off, and the drying was finished with an additional 5 minutes of the hot air flow alone. Many variations of this drying cycle may be utilized, and are within the scope of the invention, including different air temperatures and flow rates, different rotation rates, different applied voltages, and any changes in any and all of these variables during the drying cycle itself.

Although the present invention may be applied to wet honeycomb structures of virtually any size and transverse cross-sectional shape, it will be apparent that the drying uniformity obtained through the rotation of the structure about its longitudinal axis makes the invention especially useful for those honeycomb structures having circular, oval or regular polygonal transverse external cross-sections, and particularly those exhibiting relatively large cross-sectional diameters of at least about 8 inches.

Although the now preferred embodiments of the invention have been disclosed, it will be apparent to those skilled in the art that various changes and modifications may be made thereto without departing from the spirit or scope of the invention as set forth in the following claims.

We claim:

1. A method of drying a wet honeycomb structure having cells defined by cell walls, said cells extending longitudinally therethrough parallel to a longitudinal axis of said honeycomb structure which comprises:

rotating said honeycomb structure about its longitudinal axis between a pair of dielectric electrodes, applying RF energy to said dielectric electrodes while said honeycomb structure is rotated about its longitudinal axis therebetween to produce uniform dielectric heating and drying of said structure, and flowing heated air longitudinally through the cells of said rotating honeycomb structure to remove water vapors therefrom and facilitate the rapid drying of said honeycomb structure.

2. A method of drying a wet honeycomb structure as defined in claim 1 including the step of orienting said pair of dielectric electrodes so as to be parallel with said longitudinal axis of said honeycomb structure.

3. A method of drying a wet honeycomb structure as defined in claim 1 including the step of initially applying said RF energy for a desired period of time and then flowing the heated air longitudinally through the cells of said rotating honeycomb structure.

4. A method of drying a wet honeycomb structure as defined in claim 3, wherein the desired period of time is the time at which water evaporation from the cell walls is substantially uniform throughout the surface of the structure.

5. A method of drying a wet honeycomb structure as defined in claim 3 wherein the heated air is applied to said honeycomb structure after said dielectric heating has heated the honeycomb structure to a temperature of 80°-90° C.

6. A method of drying a wet honeycomb structure as defined in claim 1 including the step of applying heated air to said rotating honeycomb structure at a temperature of between about 80° C. and 120° C.

7. A method of drying a wet honeycomb structure as defined in claim 1 including the step of varying the velocity of the heated air flowing longitudinally through the cells of said rotating honeycomb structure during the drying cycle.

8. A method of drying a wet honeycomb structure as defined in claim 7 including the step of initially flowing said heated air longitudinally through the cells of said rotating honeycomb structure at one velocity, and thereafter increasing the velocity of flow through said longitudinal cells.

9. A method of drying a wet honeycomb structure as defined in claim 1 including the step of flowing said heated air longitudinally through the cells of said rotating honeycomb structure at a velocity of between about 2 and 5 meters per second.

10. A method of drying a wet honeycomb structure as defined in claim 1 including the step of interrupting the application of said RF energy to said dielectric electrodes and completing the drying of said honeycomb structure with the continued application of heated air to said rotating structure.

11. A method of drying a wet honeycomb structure as defined in claim 1 including the step of rotating said honeycomb structure about its longitudinal axis at a speed of rotation between about 1 and 6 rpm.

12. A method of drying a wet honeycomb structure as defined in claim 1, further comprising means for moving the structure parallel with and between said electrodes.

13. Apparatus for drying a wet honeycomb structure having cells extending longitudinally therethrough parallel to a longitudinal axis of said honeycomb structure which comprises:

a pair of parallel spaced-apart dielectric electrodes, means for rotating said honeycomb structure about its longitudinal axis between said pair of dielectric electrodes, means for applying RF energy to said dielectric electrodes simultaneously with the rotation of said honeycomb structure therebetween and for producing uniform dielectric heating and drying of said structure, and means for flowing heated air longitudinally through the cells of said honeycomb structure simultaneously with the rotation thereof to remove water vapor therefrom and facilitate the rapid drying of said honeycomb structure.

14. Apparatus for drying a wet honeycomb structure as defined in claim 13 wherein said pair of spaced-apart dielectric electrodes are oriented parallel to, and equally spaced-apart from, said longitudinal axis of said honeycomb structure.

15. Apparatus for drying a wet honeycomb structure as defined in claim 13 including control means for delaying the flowing of heated air longitudinally through the cells of said honeycomb structure after the initial application of said RF energy to said dielectric electrodes.

16. Apparatus for drying a wet honeycomb structure as defined in claim 13 including means for heating the air flowing longitudinally through the cells of said honeycomb structure.

17. Apparatus for drying a wet honeycomb structure as defined in claim 13 including means for controlling the temperature of the air flowing through the longitudinal cells of said honeycomb structure.

18. Apparatus for drying a wet honeycomb structure as defined in claim 13 including means for controlling the velocity of the heated air flowing longitudinally through the cells of said honeycomb structure.

19. Apparatus for drying a wet honeycomb structure as defined in claim 13 including means for varying the velocity of the heated air flowing longitudinally through the cells of said honeycomb structure during the drying of said wet honeycomb structure.

20. Apparatus for drying a wet honeycomb structure as defined in claim 13 including means for interrupting the application of RF energy to said dielectric electrodes during the drying of said wet honeycomb structure and during the flowing of heated air longitudinally through the cells of said honeycomb structure.

* * * * *